United States Patent [19]

Holtfreter

[11] Patent Number: 4,894,633

[45] Date of Patent: Jan. 16, 1990

[54] FUSE APPARATUS

[75] Inventor: Richard P. Holtfreter, Columbus, Ohio

[73] Assignee: American Telephone and Telegraph Company, New York, N.Y.

[21] Appl. No.: 282,789

[22] Filed: Dec. 12, 1988

[51] Int. Cl.[4] ..... H01H 85/34

[52] U.S. Cl. ..... 337/278; 337/201; 337/238

[58] Field of Search ..... 337/278, 273, 282, 201, 337/263, 251, 238

[56] References Cited

U.S. PATENT DOCUMENTS

| | | | |
|---|---|---|---|
| 441,933 | 12/1890 | Cartwright | 337/278 |
| 480,802 | 8/1892 | Blathy | 337/278 |
| 851,032 | 4/1907 | Rogers | 337/278 |
| 3,946,351 | 3/1976 | Bronikowski et al. | 337/224 |
| 3,983,524 | 9/1976 | Koch | 337/159 |
| 3,983,526 | 9/1976 | Koch | 337/278 |
| 4,032,879 | 6/1977 | Monagan | 337/278 |
| 4,227,228 | 10/1980 | Cheng | 361/104 |
| 4,373,556 | 2/1983 | Bergh | 138/140 |
| 4,417,226 | 11/1983 | Asdollahi et al. | 337/273 |
| 4,489,301 | 12/1984 | Johnson et al. | 337/401 |
| 4,540,969 | 9/1985 | Sugar | 337/232 |
| 4,563,666 | 1/1986 | Borzoni | 337/252 |
| 4,608,548 | 8/1986 | Borzoni | 337/201 |
| 4,656,453 | 4/1987 | Reeder | 337/236 |
| 4,736,180 | 4/1988 | Oh | 337/163 |
| 4,749,980 | 6/1988 | Morrill, Jr. et al. | 337/232 |
| 4,751,489 | 6/1988 | Spaumhorst | 337/260 |

*Primary Examiner*—H. Broome

*Attorney, Agent, or Firm*—Dwight A. Marshall

[57] ABSTRACT

An electrical fuse for mounting on a circuit board. The fuse has a housing member with terminal members engaging a fuse element intended to interrupt an external electrical circuit coupled with the terminal members upon an occurence of a fault condition in the electrical circuit. The housing member has internal arc-suppressant structure supporting and deflecting the fuse element to shield the terminal members from arcs occurring upon a failure of the fuse element in response to the fault condition.

17 Claims, 2 Drawing Sheets

FUSE APPARATUS

TECHNICAL FIELD

The invention relates to electrical fuse apparatus and in particular to a structure for a circuit board fuse.

BACKGROUND OF THE INVENTION

Circuit boards are widely used by the Electrical and Electronics Industry in the manufacture of electrical and electronic equipment. Such circuit boards are prepared with printed wiring used to interconnect electrical components that form the elements of the electrical and electronic equipment. Safety requires that electrical and electronic equipment be protected by fuse apparatus that operates upon faults occurring in the equipment circuitry to open electrical circuits and remove the electrical source supplying operating current to the equipment. The removal of the electrical source prevents overloads that may damage the electrical and electronic equipment.

Modern electrical and electronic equipment may be purchased with a minimum of circuit boards. Subsequently, new boards may be designed and added to the original equipment to update or improve the operation of the equipment. For example, personal computers oftentimes have expansion slots which enable new circuit boards such as expanded memory modules, facsimile, graphics, video and many other types of circuit boards to be mounted in the personal computer expansion slots. A problem arises in that the addition of circuit boards to equipment may change the current requirements such that additional fuses are required to insure the safe operation of the added circuit boards with the original equipment. Another problem arises in that fuses must be mounted on the circuit boards in order to meet the safety requirements for the equipment. Such circuit board fuses are required to have arc-suppressant features to minimize damage to the equipment.

SUMMARY OF THE INVENTION

The foregoing problems are solved by an electrical fuse having a fuse element connected to externally projecting terminal members for installing the fuse on a circuit board and having a housing member formed with internal arc-suppressant structure for supporting and deflecting the fuse element to shield the terminals from voltage arcs occurring upon a failure of the fuse element in response to a fault condition in an external electrical circuit protected by the fuse.

In accordance with a preferred embodiment of the invention, an electrical fuse has a fuse element for interrupting an electrical circuit upon an occurrence of a fault condition in the electrical circuit. The fuse has a frame member formed of electrical insulating material with opposing sidewalls each having a side slot and a surface channel. An air cavity is formed within the frame member for holding the fuse element and each end of the fuse element is positioned in one of the sidewall surface channels. A pair of terminal members formed of electrical conducting material are molded into opposing sidewalls with a center section of each extended into a sidewall surface channel for engaging one end of the fuse element. The fuse member has a cover member with an arc-suppressant structure positioned on one surface with the structure sized for insertion into the frame member air cavity. The arc-suppressant structure has a slot formed therein for receiving and supporting the fuse element within the frame member air cavity and wedges a portion of the fuse element within the air cavity to shield the terminal members from arcs occurring upon a failure of the fuse element. A pair of post members are positioned adjacent the arc-suppressant structures and are inserted into the frame member side slots to align and affix the cover member to the frame member.

DETAILED DESCRIPTION

Figure 1:
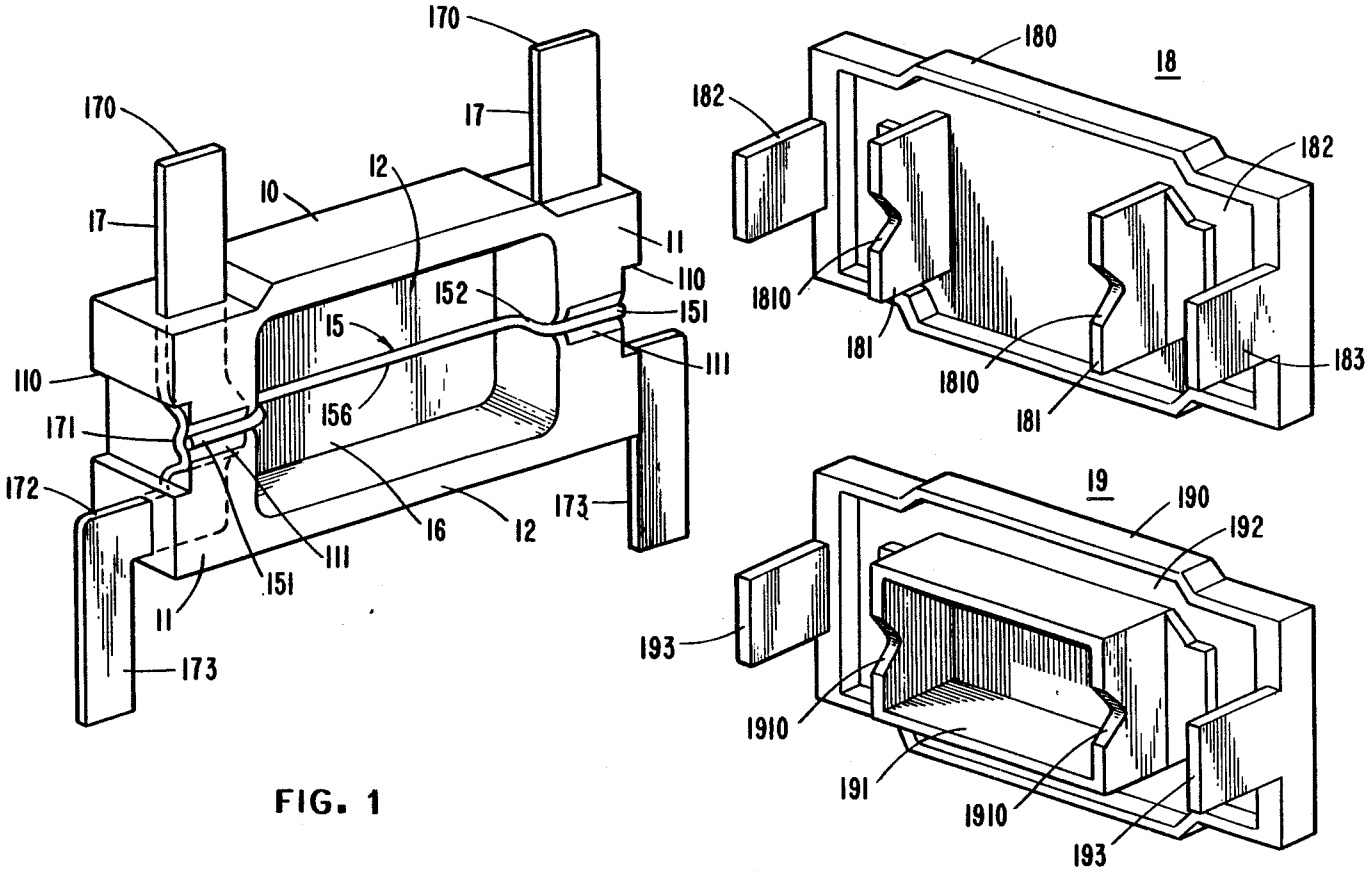
FIG. 1 illustrates an exploded view of an electrical fuse having novel structural features in accordance with the principles of the invention.

Assembled fuse 1, FIGS. 2 through 7, is intended to be mounted on a circuit board so that electrical circuitry and components mounted on the circuit board may be protected from damage that may arise as a result of the occurrence of a fault condition in electrical circuitry externally connected to terminal members 170, 173 through 177 extended outward from fuse body 10.

Fuse 1, FIG. 1 has a frame member 10 formed of an electrical insulating material such as, although not limited thereto, polyphenolene sulfide. Frame member 10 has a generally rectangular configuration with opposing pairs of sidewalls 11, 12 forming an air cavity 16 for holding fuse element 15. Fuse element 15 may be wide variety of types and sizes of elements such as a pure silver wire element intended for use in interrupting an external electrical circuit connected to terminal members 17 upon an occurrence of a fault condition in the electrical circuit.

Each of one pair of opposing sidewalls 11 may have a slot 110 formed on the outer surface thereof for use in aligning a cover member 18, 19 with frame member 10. Cover member 18 is affixed to frame member 10 to seal air cavity 16. Each opposing sidewall 11 has a surface channel 111 formed thereon for use in receiving and holding an end 151 of fuse element 15 when fuse element 15 is positioned within air cavity 16. Fuse element 15 has a general U-shaped configuration with each end 151 positioned in a corresponding sidewall surface channel 111 and which is formed to extend downward at a first right angle into air cavity 16 adjacent a side thereof and then at a second right angle across the center and interior of air cavity 16.

Fuse 1 also has a pair of generally rectangularly configured terminal members 17 formed of electrical conducting material with each molded into one of opposing sidewalls 11. Each terminal member 17 has a center section 171 formed into a generally M-shaped configuration extended into surface channel 111 of a corresponding sidewall 11 for engaging one end 151 of fuse element 15. Ends 151 of fuse element 15 may be soldered or welded by any of a number of well known methods to terminal member center sections 171 and subsequently trimmed not to extend beyond the bottom surface of slot 110.

Terminal members 17 may be formed with different configurations to mount fuse 1 on the surface of a circuit board. In a first configuration, center section 171 of each terminal member 17 may be formed to have a pair of ends 170 and 174, FIG. 4, each extended perpendicularly outward from opposite sides 12 of frame member 10 and formed at a right angle with respect to frame member 10 so that fuse 10 may be installed on a circuit board by inserting terminal member ends 170 and 174 in the contacts of a circuit board socket. In yet another configuration, terminal mebmber center section 171, FIG. 1, may have one end 170 trimmed flush with the surface of one side 12 of frame member 10 and may have another end 174, FIG. 3, extended perpendicularly outward from the opposite side 12 of frame member 10 for insertion into a circuit board socket. Terminal member end 174 may be formed into a bayonet configuration 176, FIG. 6, for insertion into a plated through hole to mount fuse 1 on a circuit board. End 174 of terminal member 17 may be split to form a gull wing configuration 175, FIG. 5, for use in mounting fuse 1 on a surface of a circuit board by interconnecting the gull wing ends 175 to printed wiring circuitry of the circuit board.

Figure 2:
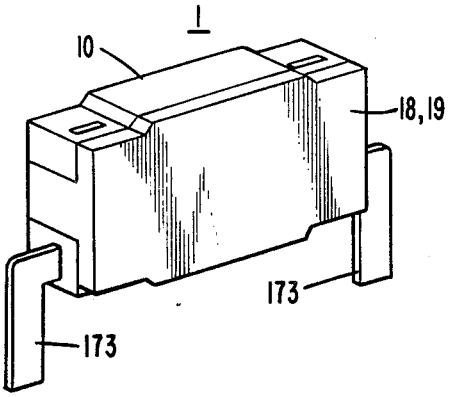
FIGS. 2 and 3 illustrates an assembled fuse of the type set forth in FIG. 1 having different configured terminal members for mounting the fuse on a circuit board.

In yet another configuration, FIGS. 1 and 2, terminal members 17 may have one end 173 thereof formed at a first right angle to extend outward from one side of the frame member opposing sidewalls 11 and then formed downward at a second right angle for use in mounting fuse 1 onto the circuit board. End 173, FIG. 7, may also be formed into a bayonet configuration 177 for insertion into a plated through hole to mount fuse 1 on the circuit board.

Figure 3:
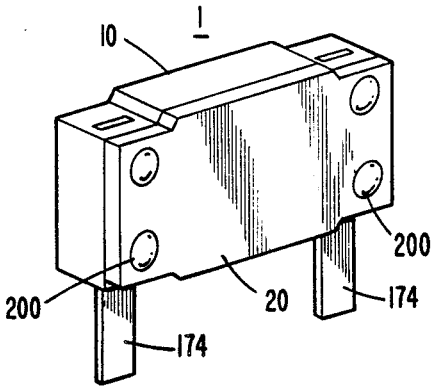
Figure 4:
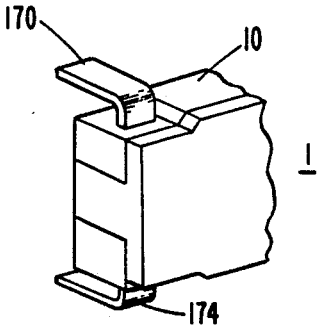
FIGS. 4 through 7 illustrate other terminal member configurations for use in mounting the fuse set forth in FIG. 1 on a circuit board.
Figure 5:
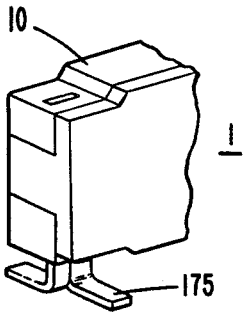
Figure 6:
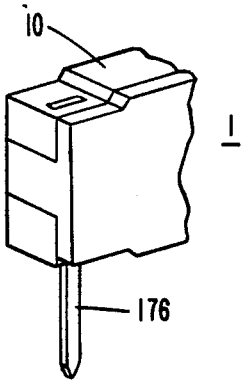
Figure 7:
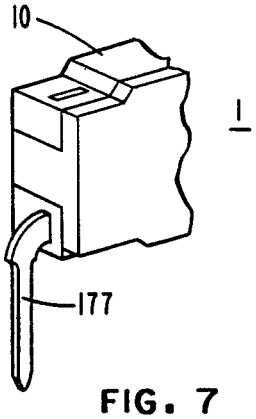

Fuse 1, FIG. 1, also has a cover member 18, 19 which is positioned on and affixed to frame member 10 to complete the assembly, FIGS. 2 and 3. Cover member 18, 19 is constructed of electrically insulating material and has a base member 180, 190, FIG. 1, with the same general overall perimeter configuration as frame member 10. In one embodiment of the invention, a generally rectangular configuration arc-suppressant structure 191, sized for insertion into frame member 11 air cavity 16, is formed on base 190 of cover member 19 to shield terminal members 17 from arcs occurring upon a failure of fuse element 15. Arc-suppressant structure 191 has slots 1910 formed in opposing sides thereof for receiving and supporting fuse element 15 in frame member air cavity 16. In yet another embodiment of the invention, cover member 18 has an arc-suppressant structure comprising a pair of opposing wall structures 181 each formed on base member 180 to be positioned adjacent a corresponding wall of frame member air cavity 16. A pair of slots 1810, are each positioned on a wall 181 for receiving and supporting fuse element 15 in frame member air cavity 16.

Each cover member 18, 19 has a pair of post members 183, 193 each positioned adjacent one of the opposing walls of the arc-suppressant structures 181, 191 for insertion into a corresponding slot 110 of frame member sides 11 so that cover members 18, 19 may be affixed to frame member 10 to complete assembly of fuse 1, FIG. 2. When cover members 18, 19 are affixed to frame member 10, FIG. 1, the center section of fuse element 15 is positioned within air cavity 16 between slots 1810, 1910 of arc-suppressant structures 181, 191. Fuse element sections 152 extended from center section 156 are wedged between the opposing walls of arcsuppressant structures 181, 191 and adjacent walls of air cavity 16. Arc-suppressant structures 181, 191 function to suppress arcs that may occur when a fault condition arises in the external electrical circuit connected to a fuse terminal members 17.

Cover member 18, 19 may be affixed to frame member 10 by use of cover member posts 183, 193 and epoxy to cement cover members 18, 19 to frame member 10, FIG. 2. In yet another configuration, posts 200, FIG. 3, may be provided on frame member 10 to extend through holes of cover 20 so that cover 20 may be affixed by ultra-sound welding techniques to frame member 10, to complete the assembly of fuse 1.

I claim:

1. An electrical fuse comprising a fuse element for interrupting an electrical circuit upon an occurrence of a fault condition in the electrical circuit, and means having externally projecting terminal means engaging said fuse element with an air cavity formed therein and with cover means having an arc-suppressant structure internally extending into said air cavity and wedged against opposing side walls of said air cavity holding said terminal means for supporting and deflecting said fuse element between said arc-suppressant structure and said opposing side walls of said air cavity to shield said terminal means from voltage arcs occurring upon a failure of the fuse element in response to the fault condition.

2. The electrical fuse set forth in claim 1 wherein said supporting and deflecting means comprises a frame member formed of electrical insulating material with pairs of opposing sidewalls forming said air cavity and with one pair of said opposing sidewalls each having a side slot and a surface channel formed for holding an end of said fuse element in engagement with said terminal means.

3. The electrical fuse set forth in claim 2 wherein said terminal means comprises a pair of terminal members each formed of electrical conducting material and each molded into one of said pair of opposing sidewalls of said frame member with a center section thereof extended into said sidewall surface channel for engaging one of said ends of said fuse element.

4. The electrical fuse set forth in claim 2 wherein said cover means comprises a cover member formed of said insulating material and having said arcsuppressant structure positioned on one surface thereof sized for insertion into said frame member air cavity wherein each opposing side of said structure has a slot formed therein for receiving and supporting said fuse element within said air cavity and having a pair of post members each positioned for insertion in said frame member side slots to affix said cover member to said frame member.

5. The electrical fuse set forth in claim 1 wherein said terminal means comprises a pair of electrical conducting members each having a pair of ends extended outward from opposite sides of said supporting and deflecting means and formed at a right angle with respect thereto for installing said fuse in a circuit board socket.

6. The electrical fuse set forth in claim 1 wherein said terminal means comprises a pair of electrical conducting members each having one end extended perpendicularly outward from one side of said supporting and deflecting means and formed into a bayonet configuration for insertion into a plated through hole of a circuit board.

7. The electrical fuse set forth in claim 1 wherein said terminal means comprises a pair of electrical conducting members each having one end extended perpendicularly outward from one side of said supporting and deflecting means and split to form a gull wing configuration for mounting said fuse on a circuit board by interconnecting said gull wing configuration to printing wiring circuitry of the circuit board.

8. The electrical fuse set forth in claim 1 wherein said terminal means comprises a pair of electrical members each formed at a first right angle to extend outward from one side of said supporting and deflecting means and formed downward at a second right angle for insertion into a plated through hole to mount said fuse on a circuit board.

9. An electrical fuse comprising a fuse element for interrupting an electrical circuit upon an occurrence of a fault condition in the electrical circuit, a generally rectangular configured frame member formed of electrical insulating material with opposing sidewalls each having a surface channel and having an air cavity formed therein for holding said fuse element with each end thereof positioned in one of said sidewall surface channels, a pair of terminal members connected with said fuse element each formed of electrical conducting material and each molded into one of said opposing sidewalls with a center section extended into said sidewall surface channel for engaging one end of said fuse element, and a cover member having arc-suppressant structures positioned on one surface thereof with said structures sized for insertion into said frame member air cavity for wedging section of said fuse element against opposing sides of said air cavity to shield said terminal members from arcs occurring upon a failure of said fuse element and wherein each arc-suppressant structure has a slot formed therein for receiving and supporting said fuse element within said frame member air cavity when said cover member is affixed to said frame member.

10. The electrical fuse set forth in claim 9 wherein each of said terminal members comprises a generally rectangularly configured member having a pair of ends each extended outward from opposite sides of said frame member and formed at a right angle with respect to said frame member for installing said fuse in a circuit board socket.

11. The electrical fuse set forth in claim 9 wherein each of said terminal members comprises a generally rectangularly configured member having one end extended perpendicularly outward from one side of said frame member and formed into a bayonet configuration for insertion into a plated through hole to mount said fuse on a circuit board.

12. The electrical fuse set forth in claim 9 wherein each of said terminal members comprises a generally rectangularly configured member having one end extended perpendicularly outward from one side of said frame member and split to form a gull wing configuration for mounting said fuse on a circuit board by interconnecting said gull wing configuration to printing wiring circuitry of the circuit board.

13. The electrical fuse set forth in claim 9 wherein each of said terminal members comprises a generally rectangularly configured member formed at a first right angle to extend outward from one of said frame member opposing sidewalls and formed downward at a second right angle for insertion into a plated through hole to mount said fuse on a circuit board.

14. An electrical fuse comprising a fuse element for interrupting an electrical circuit upon an occurrence of a fault condition in the electrical circuit, a generally rectangular configured frame member formed of electrical insulating material with opposing sidewalls each having a side slot and a surface channel and having a central air cavity formed in said frame for holding said fuse element with ends thereof each positioned in one of said sidewall surface channels, a pair of generally rectangular configured electrical conducting terminals connected with said fuse element each molded into one of said opposing sidewalls with a center section extended into said sidewall surface channel for engaging said end of said fuse element and having a pair of ends each extended outward form opposite sides of said frame member and formed at a right angle with respect to said frame member for installing said fuse in a circuit board socket, and a cover member having a generally rectangular configured arc-suppressant structure positioned on one surfae thereof with said structure sized for insertion into said frame member air cavity for wedging said fuse element against opposing sides of said air cavity to shield said terminal members from arcs occurring upon a failure of said fuse element and wherein said arc-suppressant structure has a slot formed in opposing sides thereof for receiving and supporting said fuse element within said frame member air cavity and having a pair of post members each positioned adjacent one of said arc-suppressant opposing sides for insertion in said frame member side slots to affix said cover member to said frame member.

15. An electrical fuse comprising a fuse element for interrupting an electrical circuit upon an occurrence of a fault condition in the electrical circuit.

a generally rectangular configured frame member formed of electrical insulating material with opposing sidewalls each having a side slot and a surface channel and having a central air cavity formed in said frame member for holding said fuse element with ends thereof each positioned in one of said sidewall surface channels, a pair of generally rectangular configured electrical conducting terminals connected with said fuse element each molded into one of said opposing sidewalls with a center section extended into said sidewall surface channel for engaging said end of said fuse element and having one end extended perpendicularly outward from one side of said frame member and formed into a bayonet configuration for insertion into a plated through hole to mount said fuse on a circuit board, and a cover member having a generally rectangular configured arcsuppressant structure positioned on one surface thereof with said structure sized for insertion into said frame member air cavity for wedging said fuse element against opposing sides of said air cavity to shield said terminal members from arcs occurring upon a failure of said fuse element and wherein said arc-suppressant structure has a slot formed in opposing sides thereof for receiving and supporting said fuse element within said frame member air cavity and having a pair of post members each positioned adjacent one of said arc-suppressant opposing sides for insertion in said frame member side slots to affix said cover member to said frame member.

16. An electrical fuse comprising a fuse element for interrupting an electrical circuit upon an occurrence of a fault condition in the electrical circuit, a generally rectangular configured frame member formed of electrical insulating material with opposing sidewalls each having a side slot and a surface channel and having a central air cavity formed in said frame member for holding said fuse element with ends thereof each positioned in one of said sidewall surface channels, a pair of generally rectangular configured electrical conducting terminals connected with said fuse element each molded into one of said opposing sidewalls with a center section extended into said sidewall surface channel for engaging said end of said fuse element and having one end extended perpendicularly outward from one side of said frame member and split to form a gull wing configuration for mounting said fuse on a circuit board by interconnecting said gull wing configuration to printing wiring circuitry of the circuit board, and a cover member having a generally rectangular configured arcsuppressant structure positioned on one surface thereof with said structure sized for insertion into said frame member air cavity for wedging said fuse element against opposing sides of said air cavity to shield said terminal members from arcs occurring upon a failure of said fuse element and wherein said arc-suppressant structure has a slot formed in opposing sides thereof for receiving and supporting said fuse element within said frame member air cavity and having a pair of post members each positioned adjacent one of said arc-suppressant opposing sides for insertion in said frame member side slots to affix said cover member to said frame member.

17. An electrical fuse comprising a fuse element for interrupting an electrical circuit upon an occurrence of a fault condition in the electrical circuit, a generally rectangular configurd frame member formed of electrical insulating material with opposing sidewalls each having a side slot and a surface channel and having a central air cavity formed in said frame member for holding said fuse element with ends thereof each positioned in one of said sidewall surface channels, a pair of generally rectangular configured electrical conducting terminals connected with said fuse element each molded into one of said opposing sidewalls with a center section extended into said sidewall surface channel for engaging said end of said fuse element and having one end formed at a first right angle to extend outward from one of said frame member opposing sidewalls and formed downward at a second right angle for insertion into a plated through hole to mount said fuse on a circuit board, and a cover member having a generally rectangular configured arcsuppressant structure positioned on one surface thereof with said structure sized for insertion into said frame member air cavity for wedging said fuse element against opposing sides of said air cavity to shield said terminal members from arcs occurring upon a failure of said fuse element and wherein said arc-suppressant structure has a slot formed in opposing sides thereof for receiving and supporting said fuse element within said frame member air cavity and having a pair of post members each positioned adjacent one of said arc-suppressant opposing sides for insertion in said frame member side slots to affix said cover member to said frame member.

* * * * *